US011391026B2

(12) United States Patent
Glazar

(10) Patent No.: US 11,391,026 B2
(45) Date of Patent: Jul. 19, 2022

(54) TAMPER-PROOF STRAINER AND DRAIN STOP ASSEMBLY

(71) Applicant: Greg Glazar, Bloomsbury, NJ (US)

(72) Inventor: Greg Glazar, Bloomsbury, NJ (US)

(73) Assignees: Greg Glazar, Bloomsbury, NJ (US); John Matonis, Lebanon, NJ (US)

( * ) Notice: Subject to any disclaimer, the term of this patent is extended or adjusted under 35 U.S.C. 154(b) by 0 days.

(21) Appl. No.: 17/302,780

(22) Filed: May 12, 2021

(65) Prior Publication Data

US 2021/0285196 A1 Sep. 16, 2021

Related U.S. Application Data

(60) Provisional application No. 62/989,454, filed on Mar. 13, 2020.

(51) Int. Cl.
*E03C 1/26* (2006.01)
*E03C 1/262* (2006.01)

(52) U.S. Cl.
CPC ..... *E03C 1/262* (2013.01)

(58) Field of Classification Search
CPC ..... A47K 1/14; E03C 1/262; E03C 1/2306; E03C 2001/2315; E03C 2001/2317; E03F 2005/063; E03F 2005/065; E03F 2005/066
See application file for complete search history.

(56) References Cited

U.S. PATENT DOCUMENTS

| | | | | |
|---|---|---|---|---|
| 2,296,527 | A * | 9/1942 | Kuhnle | E03C 1/262 4/287 |
| 3,027,569 | A * | 4/1962 | Lantz | E03C 1/262 4/295 |
| 3,813,708 | A | 6/1974 | Hamburg | |
| 4,502,166 | A | 3/1985 | Brown, Sr. | |
| 5,165,118 | A | 11/1992 | Cendrowski | |
| 6,044,502 | A | 4/2000 | Fountain | |
| 6,108,828 | A | 8/2000 | Cheng | |
| 6,112,694 | A | 9/2000 | Burgos | |
| 6,330,724 | B1 | 12/2001 | Belle | |
| 6,895,838 | B2 | 5/2005 | Stahnke | |
| 7,600,644 | B2 | 10/2009 | McCallum | |
| 8,496,811 | B2 | 7/2013 | Cohen | |
| 10,513,841 | B1 * | 12/2019 | Robillard | E03C 1/244 |
| 10,722,079 | B2 | 7/2020 | Schuster | |
| 2007/0034577 | A1 | 2/2007 | Bayard et al. | |
| 2020/0011038 | A1 | 1/2020 | Ahuja et al. | |
| 2020/0248441 | A1 | 8/2020 | Childs et al. | |

* cited by examiner

*Primary Examiner* — Janie M Loeppke
(74) *Attorney, Agent, or Firm* — Dunlap Bennett & Ludwig, PLLC; Anna L. Kinney

(57) ABSTRACT

A combination strainer and drain stop assembly or tamper-resistant flow control device includes a strainer body or housing; a rotatable stopper disk; a lock; and a screw extending through central apertures in the assembly. The strainer body includes a strainer disk with a planar surface and slotted openings. The slotted strainer housing has arcuate slots and a pair of diametrically opposed apertures. The stopper/flow control disk has lugs protruding through the slots and rotate the disk between an open position and a closed position. The lock includes a rectangular lock block housing a lock pin at each end and a truncated wedge. The wedge has ramp faces and a cylindrical threaded insert. The screw raises the wedge into the block when pivoted so that the pins extend through the apertures and the device is secured within a drain.

8 Claims, 3 Drawing Sheets

TAMPER-PROOF STRAINER AND DRAIN STOP ASSEMBLY

CROSS-REFERENCE TO RELATED APPLICATION

This application claims the benefit of priority of U.S. provisional application No. 62/989,454, filed Mar. 13, 2020, the contents of which are herein incorporated by reference.

BACKGROUND OF THE INVENTION

The present invention relates to strainers and, more particularly, to a tamper-proof strainer and drain stop device.

A strainer stops large particles from clogging a commercial drain. However, currently available strainers may be easily removed, causing unacceptable materials to pass through. Moreover, none of the currently available strainers can stop liquids from passing through, causing the operator to have to find alternate means to stop the drain so the sink may fill with water.

As can be seen, there is a need for a strainer that is not easily removed and can stop passage of liquids therethrough.

SUMMARY OF THE INVENTION

The inventive strainer performs all three major functions—strain, stop, and lock. The stopper may be locked into the drain using tamper proof hardware to prevent unauthorized removal.

In one aspect of the present invention, a combination strainer and drain stop assembly is provided, comprising: a strainer body comprising a strainer disk having a substantially planar surface with a first central aperture and slotted openings sized to remove predetermined particle sizes from a liquid; a rotatable stopper disk having a second central aperture and lugs extending through the slotted openings; a lock assembly comprising a lock block having a third central aperture perpendicular to an axis thereof, a locking wedge with lateral ramp faces, and a threaded insert housed within the locking wedge, wherein the lock block is configured to accommodate the locking wedge; and a screw extending through the assembly from the first central aperture through the second central aperture and the third central aperture to the threaded insert, said screw operative to raise the locking wedge into the lock block when pivoted.

In another aspect of the present invention, a tamper-resistant flow control device is provided, comprising: a lock assembly comprising a rectangular lock block slidably housing a lock pin at each end and a truncated wedge therebetween, said truncated wedge having a ramp face corresponding to each lock pin and a centrally located cylindrical threaded insert; and a slotted strainer housing having arcuate slots through which a plurality of protrusions extends from a rotatable flow control disk, said slotted strainer housing having a pair of diametrically opposed apertures; wherein the lock assembly is fastened within the slotted strainer housing with a fastener operative to raise the truncated wedge into the rectangular lock block, urging the lock pins to extend through the diametrically opposed apertures such that the tamper-resistant flow control device is secured within a drain; and wherein the plurality of protrusions is effective to rotate the rotatable flow control disk between an open position operative to enable fluid flow and a closed position operative to restrict fluid flow.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a combination strainer and drain stop that may be locked into a drain.

The strainer has small openings that allow liquids and small solids to pass and prevent large objects from passing though. The strainer may be made with openings sized to prevent predetermined particle sizes from passing through.

Under the openings, there is a plate that may rotate to close the openings so the strainer may hold back liquids. The stopper plate behind it is rotatable to allow the openings to either remain open or closed. Once closed, no items may pass and fluid flow is restricted through the strainer. The adjustable rotating strainer plate may only be placed on the inside of the strainer body.

The lock assembly uses a truncated wedge that is raised and pulled in using a tamper proof screw. The wedge pushes two plungers outward to lock or secure the strainer into the sink drain. The lock assembly may use any type of fastener or screw. By use of a tamper proof or tamper-resistant screw and expanding plungers, the strainer is difficult to remove without tools or damaging it.

The strainer may be modified in size to work in any type of drain or process where liquid flow and the passing of solids needs to be controlled.

A method of making the strainer includes the following. The strainer may be assembled by placing the adjustable rotating strainer plate into the back of the strainer main body. The lock assembly is then placed in the back and the bosses lock into the holes in the strainer body which holds it all together. A tamper proof screw is threaded down from the top.

The materials and methods of making the strainer components are not particularly limited. For example, the materials may be molded from plastic.

A method of using the inventive strainer follows. The strainer may be placed into a sink drain and the center bolt may be tightened to prevent unauthorized removal. The stopper plate may be placed in the open position or closed position depending on whether the sink needs to drain or fill. In an open position, radially extending apertures in the stopper plate align with apertures in the strainer and are operative to enable liquid flow.

Referring to FIGS. 1 through 5, FIG. 1 shows a strainer assembly 10 or tamper-resistant flow control device according to an embodiment of the present invention, comprising a strainer body 12 or housing having a cylindrical sidewall and a substantially planar strainer disk with a slotted surface, a first central aperture, and a strainer body lip 30 extending beyond the cylindrical sidewall.

Figure 3:
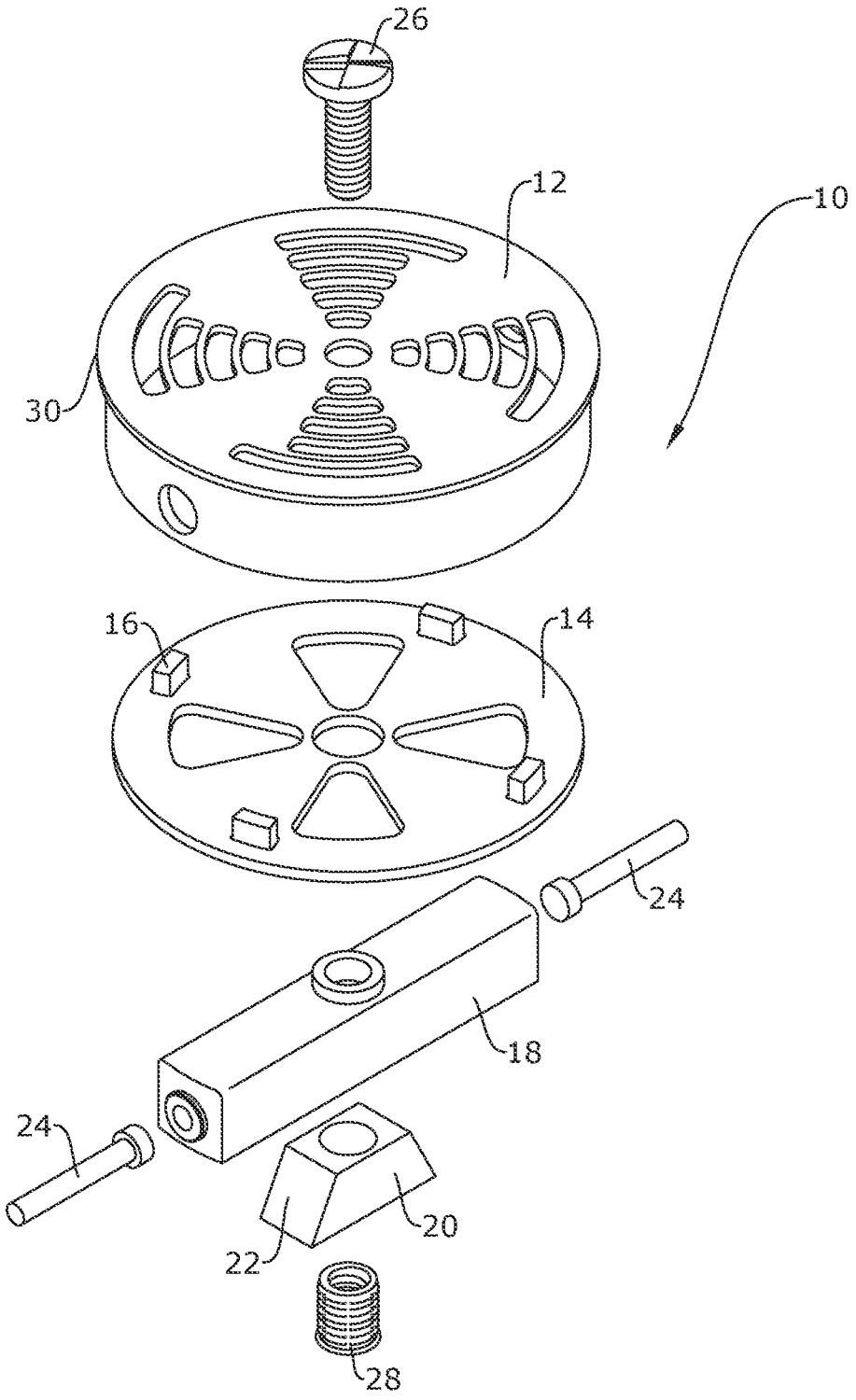
FIG. 3 is an exploded view thereof.
Figure 4:
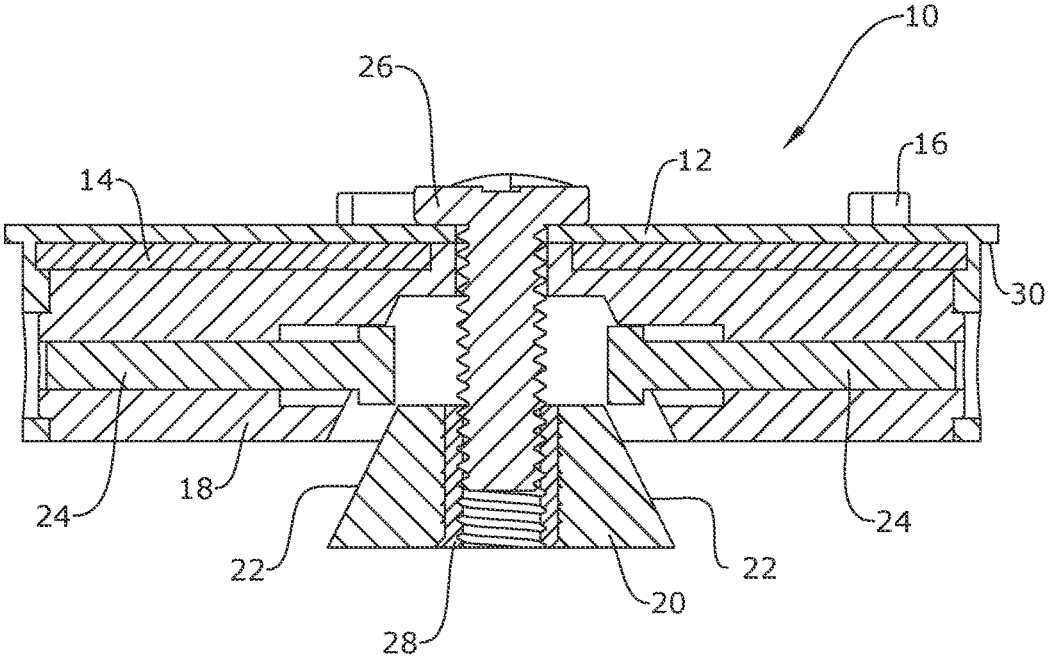
FIG. 4 is a sectional view thereof, taken along line 4-4 in FIG. 1.

FIGS. 3 and 4 illustrate the internal components of the strainer assembly 10. A rotatable strainer stop 14 disk or flow control disk attached underneath the slotted surface has apertures corresponding to the slots in the strainer body, a second central aperture, and stop moving lugs 16 or protrusions that extend therefrom through arcuate slots in the strainer body 12 slotted surface and are effective to move the stop 14 disk between an open and a closed position. A rectangular lock block 18 beneath the strainer stop 14, with a third central aperture, slidably houses a pair of lock pins 24 retractably extending axially from each end of the lock block 18 body and has a central aperture perpendicular to the axis. The cylindrical sidewall of the strainer body 12 has diametrically opposed apertures through which the lock pins 24 may slidably move. A locking wedge 20 with lateral ramp faces 22 vertically houses a centrally located threaded insert 28. The lock block 18 is configured to accommodate the locking wedge 20. A tamper proof screw 26 extends axially through the center of the strainer assembly 10, the strainer stop 14 and vertically through the lock block 18.

Figure 1:
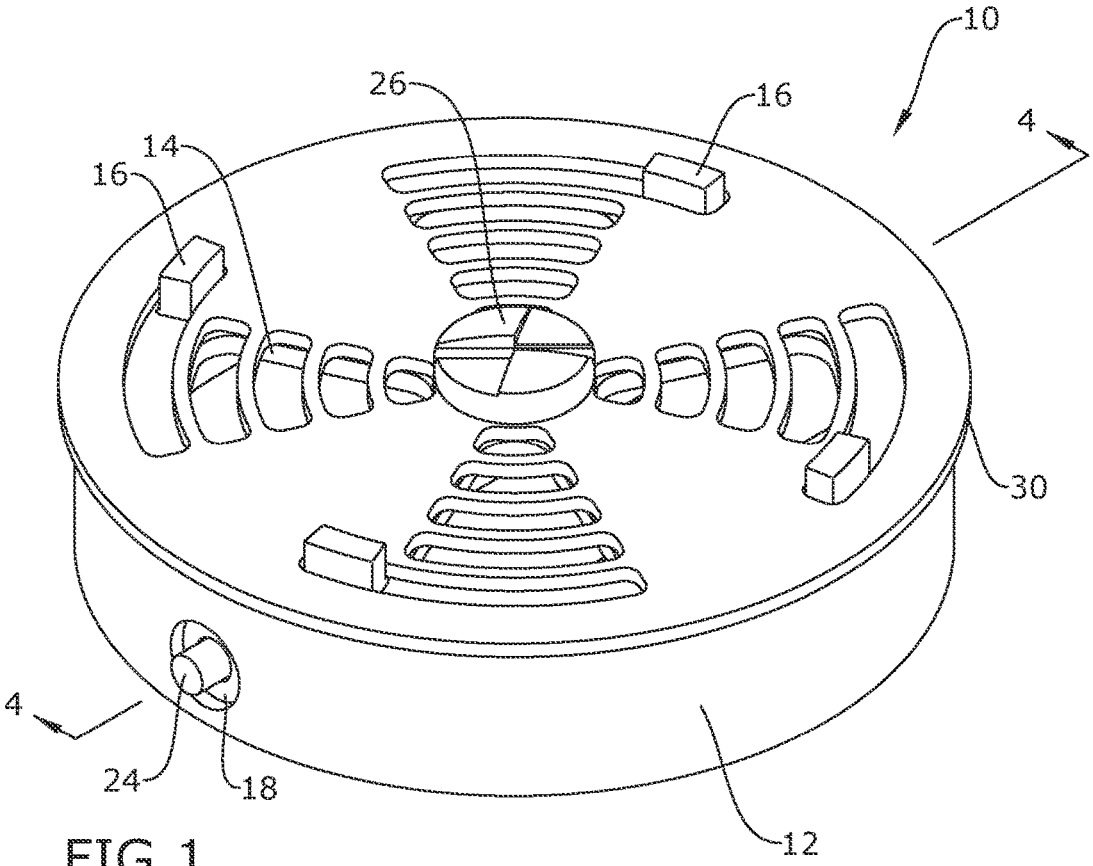
FIG. 1 is a perspective view of the invention.
Figure 2:
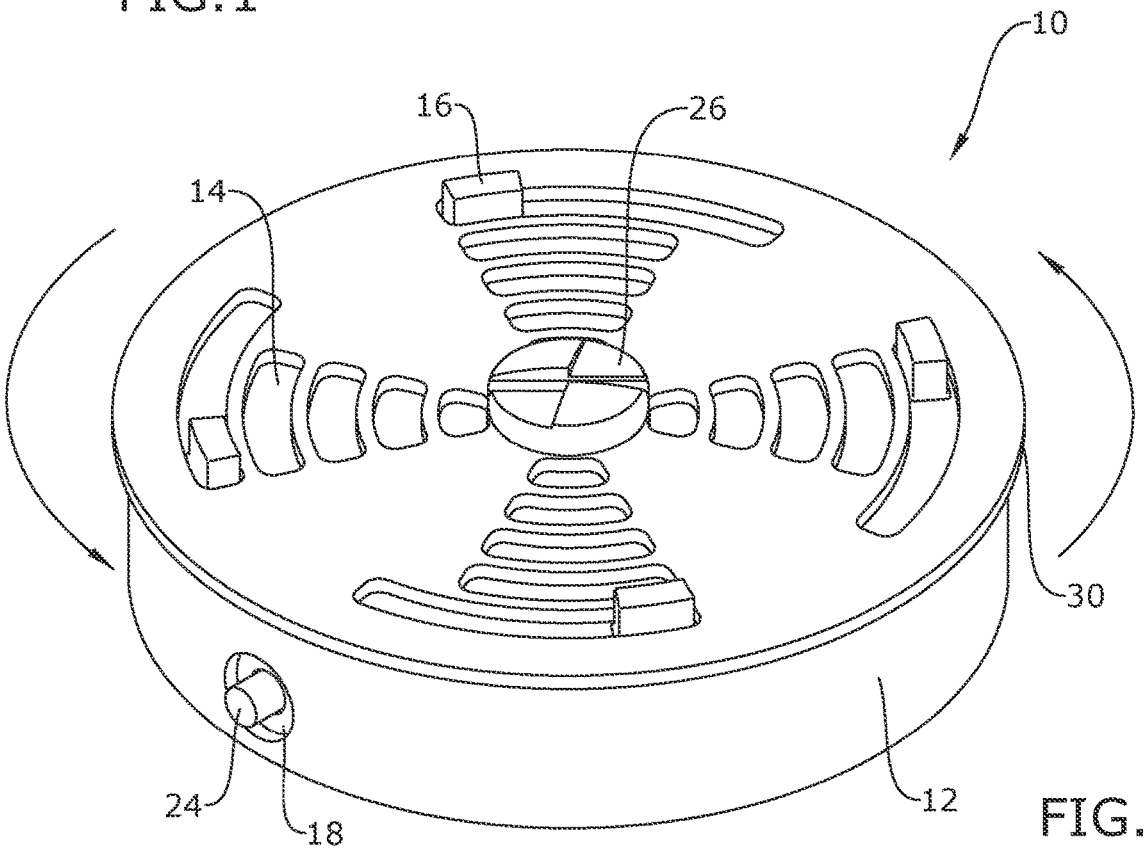
FIG. 2 is a perspective view of the invention with the stopper rotated.

As shown in FIG. 2, the slots in the strainer body 12 may be closed by sliding the stop moving lugs 16 so that the apertures align with non-slotted portions of the strainer body 12 surface, leaving the strainer body 12 slots blocked by non-apertured portions of the rotatable strainer stop 14.

Figure 5:
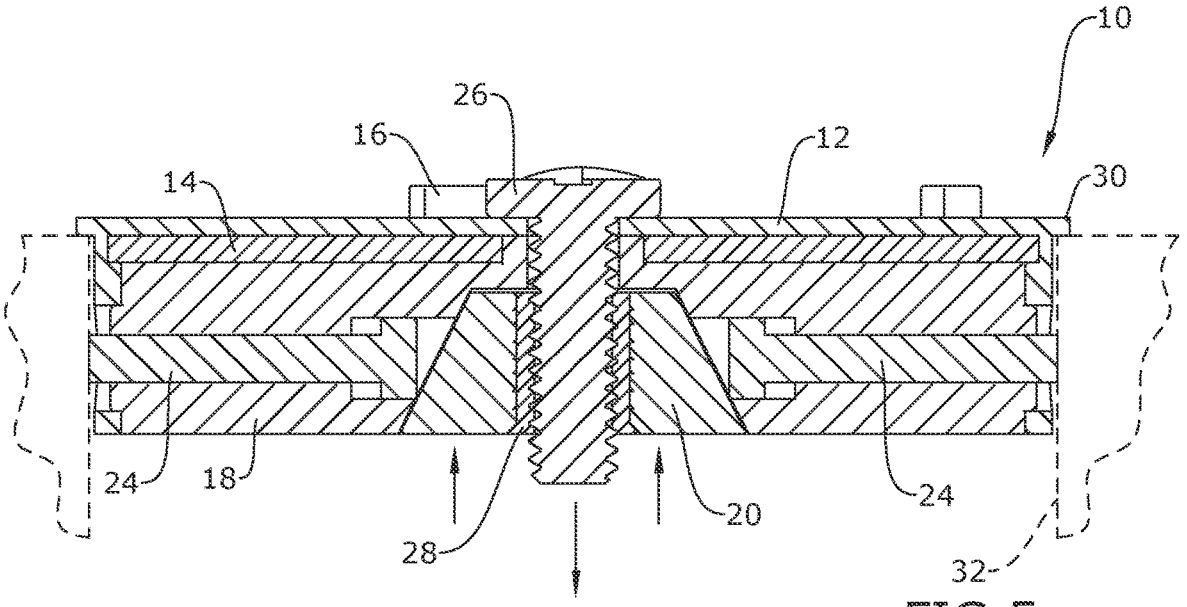
FIG. 5 is a sectional view thereof, showing the tamper proof lock undone.

As shown in FIG. 5, the strainer assembly 10 may be placed in a drain 32 with the strainer body lip 30 resting on the edge of the drain 32. As the tamper proof screw 26 pivots within the threaded insert 28, the locking wedge rises into the lock block 18, and the lock pins 24 are urged through the sidewall apertures by the ramp faces 22, locking the strainer assembly 10 so that it is fastened into place.

It should be understood, of course, that the foregoing relates to exemplary embodiments of the invention and that modifications may be made without departing from the spirit and scope of the invention as set forth in the following claims.

What is claimed is:

1. A combination strainer and drain stop assembly, comprising:

a) a strainer body comprising a strainer disk having a substantially planar surface with a first central aperture and slotted openings sized to remove predetermined particle sizes from a liquid;

b) a rotatable stopper disk having a second central aperture and lugs extending through the slotted openings;

c) a lock assembly comprising a lock block having a third central aperture perpendicular to an axis thereof, a locking wedge with lateral ramp faces, and a threaded insert housed within the locking wedge, wherein the lock block is configured to accommodate the locking wedge; and d) a screw extending through the assembly from the first central aperture through the second central aperture and the third central aperture to the threaded insert, said screw operative to raise the locking wedge into the lock block when pivoted.

2. The combination strainer and drain stop assembly of claim 1, wherein the rotatable stopper disk has a closed position operative to prevent liquid flow through the slotted openings and an open position with apertures aligned with the slotted openings to enable liquid flow.

3. The combination strainer and drain stop assembly of claim 1, wherein the screw is tamper-proof.

4. The combination strainer and drain stop assembly of claim 1, wherein the strainer body further comprises a cylindrical housing extending axially from the strainer disk such that the strainer disk forms a lip extending beyond the cylindrical housing, said cylindrical housing having diametrically opposed apertures.

5. The combination strainer and drain stop assembly of claim 4, further comprising a pair of lock pins slidably housed within, and retractably extending axially from, each end of the lock block, wherein the lateral ramp faces urge the lock pins to extend through the diametrically opposed apertures in the cylindrical housing as the locking wedge rises into the lock block.

6. A tamper-resistant flow control device, comprising:

a) a lock assembly comprising a rectangular lock block slidably housing a lock pin at each end and a truncated wedge therebetween, said truncated wedge having a ramp face corresponding to each lock pin and a centrally located cylindrical threaded insert; and b) a slotted strainer housing having arcuate slots through which a plurality of protrusions extends from a rotatable flow control disk, said slotted strainer housing having a pair of diametrically opposed apertures;

wherein the lock assembly is fastened within the slotted strainer housing with a fastener operative to raise the truncated wedge into the rectangular lock block, urging the lock pins to extend through the diametrically opposed apertures such that the tamper-resistant flow control device is secured within a drain; and wherein the plurality of protrusions is effective to rotate the rotatable flow control disk between an open position operative to enable fluid flow and a closed position operative to restrict fluid flow.

7. The tamper-resistant flow control device of claim 6, wherein the rotatable flow control disk has radially extending apertures.

8. The tamper-resistant flow control device of claim 6, wherein the fastener is a tamper-resistant screw.

* * * * *